United States Patent [19]

Winchell et al.

[11] 4,366,913

[45] Jan. 4, 1983

[54] PLASTIC CLOSURE SYSTEM WITH AN ANNULAR RIB GASKET RETENTION MEANS

[75] Inventors: David A. Winchell, Twin Lakes, Wis.; Thomas A. Fowles, McHenry, Ill.

[73] Assignee: Baxter Travenol Laboratories, Inc., Deerfield, Ill.

[21] Appl. No.: 197,876

[22] Filed: Oct. 17, 1980

[51] Int. Cl.[3] ..... B65D 41/04

[52] U.S. Cl. ..... 215/329; 215/352

[58] Field of Search ..... 215/352, 329

[56] References Cited

U.S. PATENT DOCUMENTS

| | | | |
|---|---|---|---|
| 462,154 | 10/1891 | Palmer | 215/352 X |
| 774,014 | 11/1904 | Wilson . | |
| 997,505 | 7/1911 | Hipt . | |
| 1,707,439 | 4/1929 | Kivlan . | |
| 3,513,829 | 5/1970 | Deuschle et al. . | |
| 3,721,726 | 3/1973 | Schwartzman | 264/249 |
| 4,177,905 | 12/1979 | Winchell et al. | 215/341 X |

FOREIGN PATENT DOCUMENTS

| | | | |
|---|---|---|---|
| 167159 | 5/1934 | Switzerland | 215/352 |
| 328593 | 4/1930 | United Kingdom | 215/352 |

*Primary Examiner*—Donald F. Norton

*Attorney, Agent, or Firm*—Paul C. Flattery; John P. Kirby, Jr.; Garrettson Ellis

[57] ABSTRACT

A closure system for a container having a neck with a cap support flange extending radially outwardly around the neck. A resilient gasket encircles the neck and overlies the cap support flange, to be compressed by a closure cap which is attached to the neck for sealing. Annular rib means project from the support flange against the gasket to retain the gasket in its sealing position. A method is also described for the manufacturing of such a closure system.

2 Claims, 4 Drawing Figures

PLASTIC CLOSURE SYSTEM WITH AN ANNULAR RIB GASKET RETENTION MEANS

TECHNICAL FIELD

This application relates to closures for sterile containers, such as plastic pour bottles for sterile wash solutions, used in surgical procedures for the cleaning of wounds, surgical incisions and the like.

There is a continuing need for a reduction of cost and an increase in reliability of closures for sterile solutions and other medical and biological items, such as containers for sterile reagents or parenteral solutions.

BACKGROUND ART

In Winchell et al. U.S. Pat. No. 4,177,905, a closure system for a threaded container is disclosed. A threaded closure cap has an annular skirt which engages a resilient gasket stretched over the bottle neck and overlying a cap support flange which extends radially outwardly from the neck. Downward axial movement of the cap relative to the container provides a vertical compressive force, pressing the resilient gasket against the cap support flange by the cap skirt for sealing.

However, it is of course of significant importance that the compressed gasket residing on the cap support flange should not slip outwardly to relieve its compression, which could possibly open pathways for the migration of contamination into the cap system between the neck of the container and the cap.

Furthermore, a typical cap support flange of a molded plastic closure for a container may contain a small parting line on its outer surface, which may comprise small ridges of plastic extending across the surface and being on the order of 0.005 cm. high or higher. This seemingly inconsequential ridge of plastic which may be formed at the parting line on the cap support flange may, in some circumstances contribute to a failure of a tight seal which can otherwise be formed through the use of the resilient gasket pressed between the cap support flange and the bottom of the closure cap.

By means of this invention, the above disadvantages of the prior art can be eliminated to provide a closure system seal of increased reliability at little increased cost.

DISCLOSURE OF INVENTION

By this invention, a closure system for containers is provided having a neck with a cap support flange extending radially outwardly from the neck. Such closure system may be utilized in a blow molded plastic pour bottle for medical purposes, for example, or wherever a sterile seal is desired, particularly in conjunction with a screw-type cap.

The bottle neck defines threads above the cap support flange which engage cooperating threads of a closure cap which, in turn, is carried by the neck. A resilient gasket encircles the neck and overlies the cap support flange, with the gasket being positioned directly underneath the closure cap and compressed between the closure cap and cap support flange in a sealing position, to prevent the migration of any contamination under the closure cap.

In accordance with this invention, first annular rib means are provided to project from the support flange against the gasket, to retain the gasket in its sealing position. As stated above, due to the compression of the gasket, it may have a tendency to be driven radially outwardly, since the compression of the gasket can be relieved in that manner. Thus, in the event that frictional forces between the gasket and the closure cap and cap support flange are insufficient to retain the gasket in its normal, highly compressed position, the gasket may tend to slip outwardly, reducing the reliability of the seal.

By this invention, the first annular rib means defined in the cap support flange serves as a retention means for holding the gasket in its inner, compressed position. Preferably, the first annular rib is positioned radially outwardly beyond the closure cap, which improves its characteristic of causing retention of the sealing gasket in its desirably-compressed position, and prevents outward sliding of the gasket.

Furthermore, it is preferred for second annular rib means to project from the support flange against the gasket at a position which is radially inward of the first annular rib means, for further retention of the gasket. Both first and second annular rib means may be simultaneously formed by an assembly method described below, and at the same time the cap support flange may be reformed to eliminate parting lines and other discontinuities on its sealing surface, particularly between the first and second annular rib means. It is also preferred for the second annular rib means to be positioned radially inwardly of the closure cap.

The resilient gasket may also project into an annular groove defined between the second annular rib means and the neck, for added sealing capability.

The above closure structure may be made from a closure in which the cap support flange and typically also the neck and remainder of the container are made of a thermoplastic material as a single, molded piece. By a preferred manufacturing method, a cylindrical, heated die is brought against the outwardly-facing surface of the cap support flange, with a majority of the surface of the die which engages the cap support flange being flat and free of discontinuities. Accordingly, the facing outer surface of the cap support flange may be reformed by interaction with the hot die, to flow into the flat surface configuration of the shaping end of the die to remove surface discontinuities such as parting lines.

Typically, the face of the die which engages the surface of the cap support flange defines annular groove means, with the remainder of the engaging surface of the die being flat and smooth.

As the result of this, the outwardly-facing surface of the cap support flange, while being reformed into the flat surface described above, also is reformed to define the first annular rib means projecting from the support flange, as previously discussed.

Thereafter, the die may be withdrawn, and the resilient gasket may be encircled about the neck to overlie and press against the cap support flange and the formed first annular rib means.

Then, the closure cap may be attached onto the neck, with the closure cap pressing the resilient gasket into tight, sealing engagement with the outwardly-facing surface of the cap support flange and the first annular rib means.

At the same time, the cylindrical die means can also form the second annular rib means as it is pressed against and into the cap support flange, by inward flowing of molten thermoplastic material of the cap support flange across the inner edge of the cylindrical die means. Thus, advantageously, the second annular rib means may be elevated with respect to the first annular rib means for tighter engagement with the resilient gasket.

DESCRIPTION OF THE SPECIFIC EMBODIMENT

Figure 1:
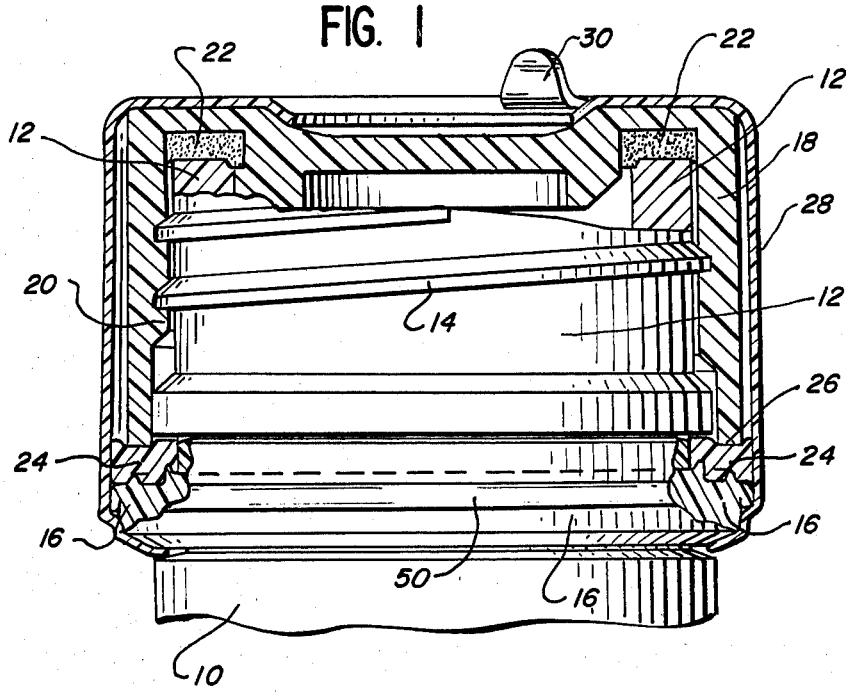
FIG. 1 is an elevational view, taken partly in vertical section, showing a closure in accordance with this invention for a plastic pour bottle.

Referring to the drawings, FIG. 1 shows a closure for a plastic pour bottle for sterile solutions, which may be similar in design to that of the cited U.S. Pat. No. 4,177,905, except as otherwise described herein.

Plastic bottle 10 comprises a neck 12, having threads 14 above a support flange 16, which extends radially outwardly from the neck as shown.

Closure cap 18 is shown having cooperating threads 20, mating with threads 14 of neck 12, so that the closure cap may be screwed onto the neck in conventional manner, and correspondingly removed.

Upper gasket 22 is provided at the lip of neck 12 for providing an upper seal in a manner described in the previously-cited patent.

Resilient gasket 24, which may be made of highly resilient silicone rubber material, is positioned to be pressed between the lower annular skirt end 26 of cap 18 and the outer face of cap support flange 16, for compression of resilient gasket 24. This provides a sterile seal, preventing the migration of any contamination into the closure underneath cap 18.

Additionally, an outer member of heat-shrinkable material 28, having an opening member 30 at the top, may be provided in accordance with the previously-cited patent.

Figure 4:
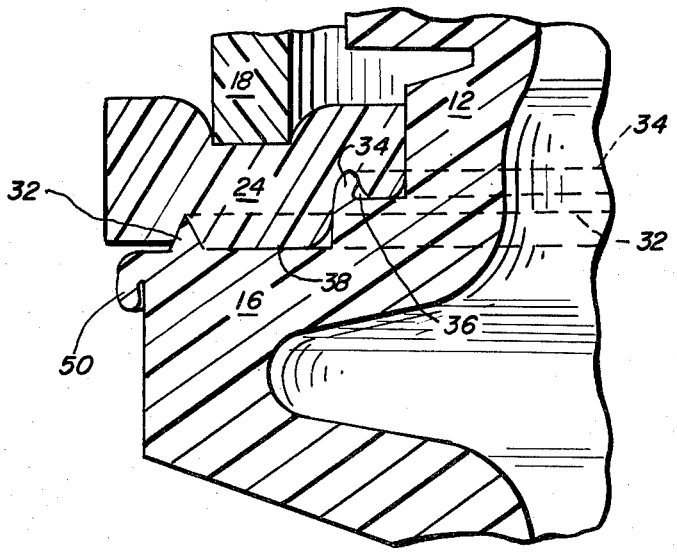
FIG. 4 is an enlarged, fragmentary view, taken in vertical section, of a detail of the closure of FIG. 1.

As particularly shown in the detailed view of FIG. 4, first annular rib means 32 projects from support flange 16 and extends entirely around neck 12 of the closure, pressing against gasket 24 completely about the periphery of neck 12 to retain the gasket in sealing position.

As previously stated, it is preferred for first annular rib 32 to be positioned outwardly beyond closure cap 18 as shown, for better retention of gasket 24.

At the same time, second annular rib means 34 also projects from the support flange as particularly shown in FIG. 4, pressing against gasket 24 at a position which is radially inward of the first annular rib means 32, and also preferably radially inward of closure cap 18, as shown.

Surprisingly, resilient gasket 24 can project into an annular groove 36 defined between second rib 34 and neck 12 as a spontaneous result of the pressure of cap 18 against gasket 24, for added sealing.

Particularly, the gasket-facing surface 38 of cap support flange 16, particularly between first and second ribs 32, 34, may be free of parting lines and other irregularities, for improved sealing characteristics in accordance with this invention, with the structure being made by the method as described below.

Thus a compressed annular seal at gasket 24 is provided, and gasket 24 is firmly retained and prevented from outward migration due to the natural tendency toward stress relief, by the presence of first annular rib 32 and also second annular rib 34. Thus an improved, hermetic seal is provided to the system until cap 18 is opened.

Figure 2:
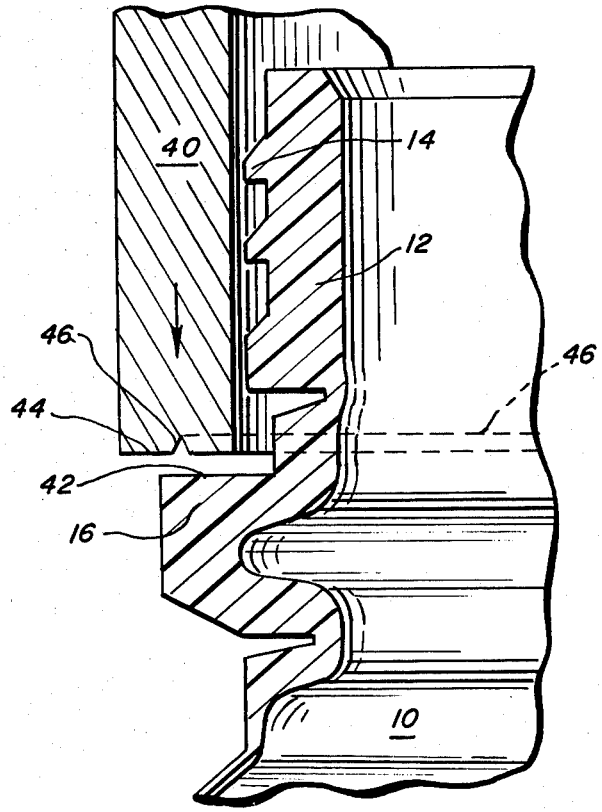
FIG. 2 is an enlarged, fragmentary view, taken in vertical section, of a step in the manufacture of the closure of FIG. 1.

Referring to FIG. 2, a preliminary step in the assembly method of this invention is disclosed.

The preformed neck 12 of container 10, having cap support flange 16 extending radially outwardly from neck 12, preferably is made as a single, blow-molded structure of thermoplastic material, for example polypropylene containing a minor percentage of ethylene units, or the like.

A cylindrical, heated die 40 may be advanced about container neck 12 to press against and into the outwardly-facing surface 42 of cap support flange 16. The face 44 of die 40 which engages surface 42 defines an annular groove 46, while the remainder of the surface 44 which engages cap support flange 16 may be flat and smooth.

Figure 3:
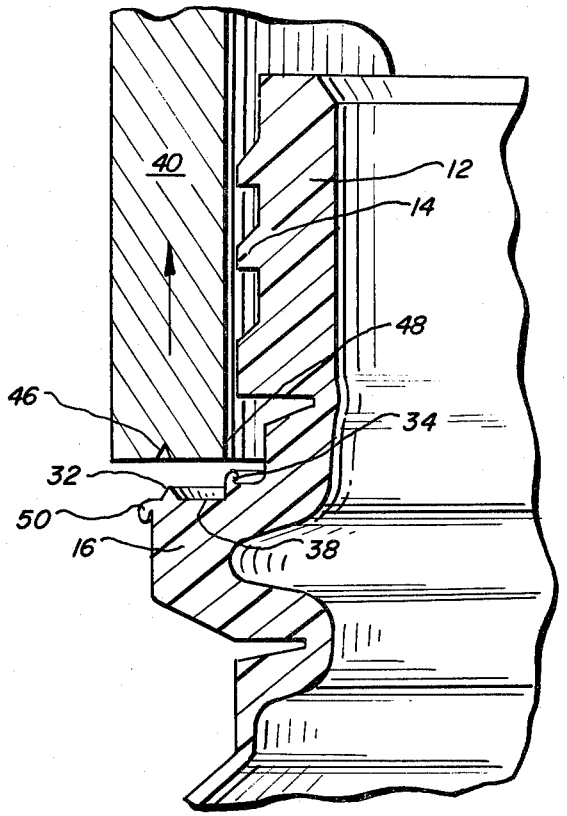
FIG. 3 is another enlarged, fragmentary view, taken in vertical section, of a subsequent step in the assembly process as shown in FIG. 2.

Accordingly, as shown in FIG. 3, heated die 40 may be advanced to press and shape the outer surface of cap support flange 16, and then withdraw again, with first annular rib 32 being thus formed, and the remaining newly formed surface 38 being free of any discontinuities such as the original parting lines where they exist and also other scratches, nicks, and the like, to provide a preferably flat, continuous sealing surface 38.

At the same time, due to the advancement of hot die 40 into cap support flange 16, melted thermoplastic material of the cap support flange is pressed inwardly, to flow across the edge 48 of die 40 to form the second annular rib 34 which defines, in turn, groove 36. Second annular rib 34 may thus be elevated over first annular rib 32 for advantage in sealing.

Simultaneously, an outer projecting rib 50 is usually also formed by the advancement of die 40.

After this, die 40 may be completely withdrawn, and the resilient gasket 24 may be encircled about neck 12 to overlie and press against cap support flange 16 and the first and second annular ribs 32, 34. Preferably resilient gasket 24 fits rather tightly against neck 12 so as to snap into place.

Thereafter, closure cap 18 may be attached upon screw threads 14 of neck 12 and screwed down to press resilient gasket 24 into its tight, sealing engagement with the forwardly-facing surface 38 of cap support flange 16 and the first and second annular ribs 32, 34.

The result of this is to provide an improved hermetic seal in which resilient gasket 24 cannot migrate outwardly, so that its compression is not relieved but is retained over a long period of time for maintenance of a high quality, hermetic seal until cap 18 is removed. Also a flat sealing surface may be provided to avoid pin hole leaks.

The above has been offered for illustrative purposes only, and is not intended to limit the scope of the invention of this application, which is as defined in the claims below.

That which is claimed is:

1. In a closure system for a container having a neck with a cap support flange extending radially outwardly from the neck, the neck having threads above the support flange engaging cooperating threads carried by a closure cap carried by said neck, and a resilient gasket encircling said neck and overlying said cap support flange, said gasket being positioned directly underneath said closure cap and compressed between said closure cap and cap support flange in a sealing position, the improvement comprising, in combination:

first annular rib means projecting from said support flange into said gasket to retain said gasket in its sealing position, said first annular rib means being positioned radially outwardly beyond said closure cap; and second annular rib means projecting from said support flange into said gasket at a position which is radially inward of said first annular rib means and closure cap, the gasket-facing surface of the cap support flange being free of parting lines and other irregularities between said first and second annular rib means, said gasket projecting into an annular groove defined between said second annular rib means and said neck.

2. The closure system of claim 1 in which said second annular rib means is elevated over said first annular rib means.

* * * * *